United States Patent [19]

Baba et al.

[11] 4,284,437

[45] Aug. 18, 1981

[54] PROCESS FOR PREPARING HARD TEMPERED ALUMINUM ALLOY SHEET

[75] Inventors: Yoshio Baba, Nagoya; Shin Tsuchida, Toyoake; Masaaki Tobinaga, Nagoya, all of Japan

[73] Assignee: Sumitomo Light Metal Industries, Ltd., Tokyo, Japan

[21] Appl. No.: 105,008

[22] Filed: Dec. 18, 1979

[51] Int. Cl.[3] ..... C22F 1/04; C22C 21/06

[52] U.S. Cl. ..... 148/11.5 A; 148/12.7 A

[58] Field of Search ..... 148/2, 11.5 A, 12.7 A, 148/159; 75/142, 147, 138; 113/120 H; 29/527.7

[56] References Cited

U.S. PATENT DOCUMENTS

| | | | |
|---|---|---|---|
| 3,502,448 | 3/1970 | Anderson et al. | 75/147 |
| 3,802,031 | 4/1974 | Bylund | 148/11.5 A |
| 4,021,271 | 5/1977 | Roberts | 148/2 |
| 4,033,794 | 7/1977 | Stowell et al. | 75/147 |
| 4,043,840 | 8/1977 | Sperry et al. | 75/142 |
| 4,081,294 | 3/1978 | Thompson et al. | 148/11.5 A |
| 4,093,474 | 6/1978 | Sperry et al. | 148/2 |
| 4,151,013 | 4/1979 | Thompson et al. | 148/11.5 A |
| 4,186,034 | 1/1980 | Akeret | 148/11.5 A X |

OTHER PUBLICATIONS

Thorley et al., "The Control of Earing in Aluminum and Its Alloys", Journal of the Institute of Metals, vol. 86, 1957–1958, pp. 353–361.

*Primary Examiner*—Peter K. Skiff

*Attorney, Agent, or Firm*—Blanchard, Flynn, Thiel, Boutell & Tanis

[57] ABSTRACT

A hard tempered aluminum alloy sheet useful for deep drawing is prepared by a process comprising the steps of hot rolling an ingot of aluminum alloy consisting essentially of 4.0 to 6.0 Mg wt. %, at least one component selected from the group consisting of 0.1 to 0.7 wt. % Mn, 0.01 to 0.05 wt. % Zr, 0.005 to 0.12 wt. % V and up to 0.05 wt. % Ti and the balance aluminum to a sheet not more than 2.5 mm thick, intermediate annealing the hot rolled alloy and final cold rolling the annealed alloy to effect a rolling reduction of less than 85%.

In case the finishing temperature of the hot rolling is adjusted to a temperature of 300° to 350° C., the above intermediate annealing can be omitted.

14 Claims, 1 Drawing Figure

PROCESS FOR PREPARING HARD TEMPERED ALUMINUM ALLOY SHEET

BACKGROUND OF THE INVENTION

The present invention relates to a process for preparing a hard tempered aluminum alloy sheet useful for deep drawing and particularly to an aluminum alloy sheet which can give a small ratio of ears of 45° to a rolling direction (hereinafter referred to as "45° earing ratio") when deep drawing.

AA Alloy No. 5082 and AA Alloy No. 5182 are well known as suitable materials for cans for beverages, food and other goods and they normally are employed in the hard tempered state which is achieved by a final cold rolling to effect a rolling reduction of more than 70%. This hard tempered state imparts a high degree of strength to the aluminum alloy. In such alloys, as the cold reduction amount is increased, the work-hardening and strength increase at the same time and the 45° earing ratio also becomes large. Generally, a 45° earing ratio of more than 4% is not preferable for the deep drawing material. Therefore, in order to lower the above-mentioned earing ratio to below the acceptable maximum value without lowering the strength to below the required level, the rolling reduction quantity of the final cold rolling must be limited to a proper range.

Conventionally, the above-mentioned alloy has been formed into a hard tempered sheet 0.3 to 0.4 mm thick by homogenizing an ingot of the alloy, hot rolling to a thickness of 3 to 5 mm, cold rolling, intermediate annealing and final cold rolling. The thickness of the sheet after intermediate annealing depends mainly upon both the final cold rolling reduction and the thickness which can impart sufficient strength and small 45° earing ratio to the resulting hard tempered alloy sheet after final cold rolling. Generally, the alloys are final cold rolled to a reduction of at least 80% to achieve a sufficient strength as can materials. However, in this case, the 45° earing ratio is about from 5% to 7%. In the case of shallow drawing, this 45° earing ratio does not matter, but in the case of deep drawing, this 45° earing ratio is not acceptable, since a large 45° earing ratio causes a lowering of yield rate and trouble during working. When the final cold reduction is less than 80%, sufficient strength can not be obtained, so that the thickness of the hard alloy sheet must be thickened by using a greater amount of the alloy to achieve a sufficiently strong sheet. However this causes an increase of cost and it is not preferable economically. Further, when the composition of the alloy is varied so as to achieve a required strength, both the formability and corrosion-resistance are injured. A desired 45° earing ratio for a deep drawing material is not more than 3.5%.

SUMMARY OF THE INVENTION

It is therefore an object of the invention to eliminate the above-mentioned shortcomings of the prior art, and more particularly, to provide a process for preparing a hard tempered aluminum alloy sheet useful as a deep drawing material.

It is a further object of the present invention to provide a hard tempered aluminum alloy sheet having an excellent strength, workability and corrosion-resistance.

In accomplishing these objects, the present invention provides a novel process for preparing hard tempered aluminum alloy sheet comprising the steps of hot rolling a ingot of aluminum alloy consisting essentially of 4.0 to 6.0 wt.% Mg, at least one component selected from the group consisting of 0.1 to 0.7 wt.% Mn, 0.01 to 0.05 wt.% Zr, 0.005 to 0.12 wt.% V and up to 0.005 wt.% Ti, and the balance aluminum to a sheet not more than 2.5 mm thick, thereafter intermediate annealing the hot rolled alloy and final cold rolling to effect a rolling reduction of less than 85%, preferably 40 to less than 85% and most preferably 70 to less than 85%.

The above and further objects, feature and advantages of the present invention will be more apparent from the following description and the accompanying drawing.

BRIEF DESCRIPTION OF THE DRAWING

The drawing is a graph plotting the tensile strength and 45° earing ratios and ears in 0° and 90° to rolling direction (hereinafter referred to as "90 earing ratio") versus various rolling reductions of 0% to 90%.

DETAILED DESCRIPTION

Figure 1:
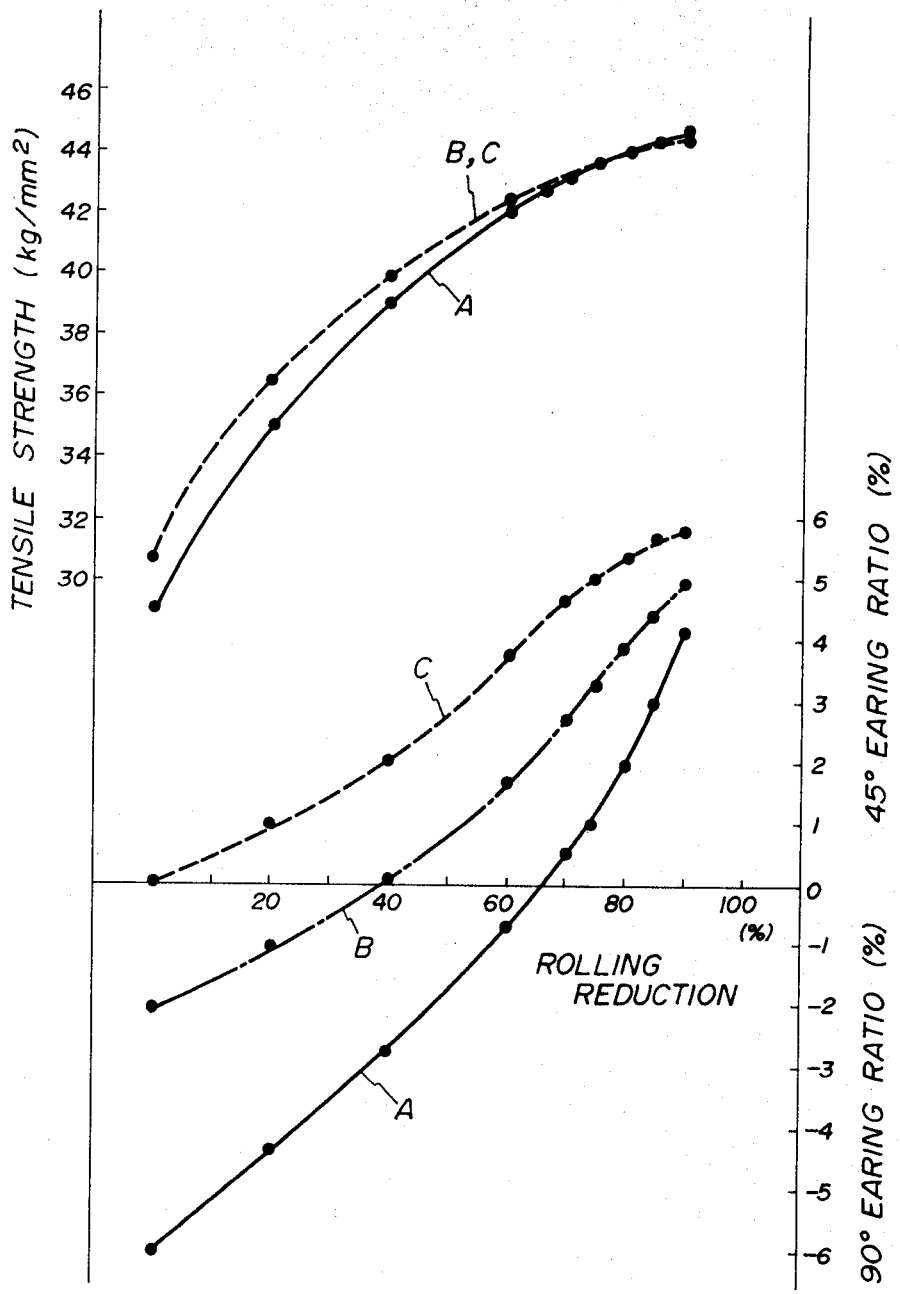

As indicated hereinabove, the aluminum alloy according to the present invention consists essentially of 4.0 to 6.0 wt.% Mg, at least one component selected from the group consisting of 0.1 to 0.7 wt.% Mn, 0.01 to 0.05 wt.% Zr, 0.005 to 0.12 wt.% V and up to 0.05 wt.% Ti, and the balance aluminum and each component produces the following effect.

Mg determines the strength of the finally obtained hard tempered alloy sheet. When the content is less than 4 wt.%, a sufficient strength can not be obtained, while when it is more than 6 wt.%, the workability is decreased.

Mn serves to increase the strength, Zr and V confine the lowering of strength effected during baking the coatings applied to the aluminum alloy sheet to the minimum and Ti serves effectively to make the grain of the aluminum alloy ingot fine and to make the properties of the final product uniform, within the respective contents thereof. If the Mn, Zr, V and Ti contents are less than their respective lower limits, the above-mentioned effects can not be obtained, while if the contents exceed their respective upper limits, large intermetallic compounds are produced and the thus produced compounds cause damage to the workability of the hard aluminum alloy sheet.

The above alloy of the present invention is preferably subjected to a homogenizing treatment after casting according to conventional practice. The homogenizing treatment serves effectively to make fine the intermetallic compounds formed during casting, thus improving the workability of the hard tempered alloy sheet. This homogenizing is conducted by heating for 3 to 10 hours at a temperature of from 480° to 540° C. The thus homogenized alloy ingot is heated to about 500° C. and then is hot rolled to a desired intermediate thickness as usual.

In the case of the present invention, the intermediate thickness after hot rolling is not more than 2.5 mm and this thickness is an extremely important point for the present invention. This intermediate thickness should be designed so that the hard tempered sheet having the thickness of less than 0.4 mm can be obtained after final cold rolling to effect a rolling reduction of less than 85%.

The thus hot rolled alloy is subsequently subjected to intermediate annealing and to final cold rolling as described hereafter so as to obtain the contemplated alloy sheet product. In the present invention, the conventional cold rolling is not conducted before intermediate annealing and this point is also of great importance in the present invention.

The above characteristic steps can readily give a small 45° earing ratio to the alloy sheet when deep drawing.

If, as in the conventional process, intermediate cold rolling is conducted before intermediate annealing, a 90° earing ratio of more than 2% can not be obtained owing to the interaction between the cold rolling texture formed in the intermediate cold rolling and Mg being one component of the aluminum alloy. The 45° earing ratio of the finally obtained tempered sheet decreases with an increase in the 90° earing ratio of the intermediate annealed sheet and a 90° earing ratio of less than 2% does not meet the objects of the present invention. However, if hot rolling is subsequently followed by intermediate annealing, the desired 90° earing ratio, that is, 5 to 6% can be readily gained and finally a hard tempered sheet having a small 45° earing ratio can be prepared after the final cold rolling as will be apparent from the following examples. The above modification in the preparing process can provide an excellent hard tempered aluminum alloy material useful for deep drawing.

The intermediate annealing after hot rolling is performed by heating at 300° to 350° C. for about 1 hour. This intermediate annealing can accomplish softening and recrystallizing of the hot rolled aluminum alloy and promotes mainly precipitation of Mg being one component of the aluminum alloy, so that a highly improved workability of the hard tempered aluminum alloy can be obtained as well as a stabilized and small 45° earing ratio. If the intermediate annealing temperature is less than 300° C., the above effects can not be sufficiently achieved, while, if the temperature exceed 350° C., grain growth occurs and a large recrystallized grain structure is formed. The thus formed structure further causes an increase in the 45° earing ratio as well as lowering of workability. Particularly, an increase of the 45° earing ratio is caused by the preferred grain growth in the specific direction during intermediate annealing.

Besides the above intermediate annealing, recrystallizing is also performed by regulating the finishing temperature of the hot rolling at the final stage of the hot rolling to the range of a temperature from 300° to 350° C. The above finishing temperature was adjusted by the starting temperature of the hot rolling, cooling with a lubricant, transmitting the heat to the roller of a rolling mill, radiating the heat into the air and the heat generated by the hot rolling during the hot rolling operation. Generally, the starting temperature of the hot rolling is approximately 500° C. (460° to 540° C.) and in order to adjust the finishing temperature of hot rolling to the temperature of 300° to 350° C., it takes 5 to 10 minutes from the starting to finish of hot rolling.

The thus crystallized aluminum alloy sheet is then subjected to final cold rolling to effect a rolling reduction of less than 85%, preferably 40 to less than 85%, and most preferably 70 to less than 85%. The hard tempered sheet of less than 0.4 mm in thickness can be prepared by the above final cold rolling operation in connection with intermediate thickness achieved by hot rolling and a 45° earing ratio of less than 3% can be also obtained. When the cold reduction is 85% and over, a 45° earing ratio of less than 3% can not be obtained. Also, further, it is desirable to perform stabilizing treatment at not more than 250° C. after the final cold rolling. This treatment promotes the natural softening which occurs by natural aging at room temperature and stabilizes the hardness of the resulting alloy sheet to the proper level. Further, the stabilizing treatment gives the alloy sheet a high degree of formability. The present invention will be more clearly understood with reference to the following Examples.

EXAMPLE 1

TABLE 1

| Comnent | Si | Fe | Cu | Mn | Mg | Cr | Zn | Ti | Al |
|---|---|---|---|---|---|---|---|---|---|
| Contents (wt. %) | 0.08 | 0.18 | 0.01 | 0.33 | 4.6 | 0.04 | 0.01 | 0.01 | Balance |

The aluminum alloy composition shown in the above Table 1 was casted by the usual practice and thereafter homogenized by heating for 10 hours at 525° C. The homogenized alloy was hot rolled to provide three kinds of sheets A, B and C having respectively 2 mm, 3 mm and 4 mm in thickness and the thus treated sheets B and C were subsequently cold rolled in accordance with the conventional practice to thickness of 2 mm. All the finishing temperatures of the sheets at the final stage of the hot rolling operation are from 305° to 325° C. Next, the above respective sheets were subjected to intermediate annealing for 1 hour at 350° C. to recrystallize the internal structure. After the above intermediate annealing, final cold rolling was performed to effect various rolling reductions of 0 to 90%. The tensile strength and each of 45° and 90° earing ratios against various rolling reductions were measured and are plotted in the drawing. In the drawing, curves A, B and C represent the results of sheets A, B and C, respectively.

From the drawing, it is clear that when the cold rolling reduction is less than 60%, the tensile strength of sheet A according to the present invention is approximately 1 to 2 kg/mm$^2$ less than those of sheets B and C, which are comparative sheets, but when the cold rolling reduction exceeds 60%, A, B and C were approximately equal in the tensile strength and hardly any effect of cold rolling before annealing on tensile strength was detected. Also, sheets B and C according to conventional practice exhibited similar results in tensile strength, although they are different in thickness after hot rolling.

Moreover, referring to the 90° earing ratio after intermediate annealing, sheet A according to the present invention exhibited a value of 6%, while conventional sheets B and C exhibited values of 0 to 2%. It can be seen from the drawing that the 45° earing ratio increases with an increase in the rolling reduction and that the difference between the earing ratio of sheet A and those of sheets B and C before final cold rolling also appears after final cold rolling. The 45° earing ratio of sheet A is less than those of sheets B and C and, for example, those of sheet A for rolling reductions of 80% and 84% were 2 to 3% and 1 to 2%, respectively, less than those of sheets B and C. For rolling reductions of 80% and 84%, since the tensile strength of sheet A is similar to those of sheets B and C, the alloy sheet having extremely small 45° earing ratio and the same strength as the conventional alloy sheet can be obtained in accordance with the present invention at the same time.

However, if the rolling reduction is 85% and more than 85%, the 45° earing ratio exceeds 3%, and so the rolling reduction must be regulated to be not more than 85%.

For the further examination, a stabilizing treatment was conducted on respective sheets 0.32 mm thick prepared by final cold rolling reduction of 84% by heating for 1 hour at 170° C., thus obtaining three kinds of stabilized sheets $A_1$, $B_1$ and $C_1$ corresponding to the above alloy sheets A, B and C, respectively. The properties of each of sheets $A_1$, $B_1$ and $C_1$ as shown in Table 2 were examined and summarized in it.

Still further, another alloy sheet $A_2$ corresponding to the above sheet $A_1$ was prepared in the same way as described above except for omitting the intermediate annealing and was examined on the properties indicated in the Table 2. The result of the non-intermediate annealed sheet $A_2$ was similar to that of sheet $A_1$ as can be seen from the table. This result was brought by adjusting the finishing temperature of hot rolling to the temperature sufficient for recrystallizing, that is, 305° to 325° C.

From the above result, it is found that in case the finishing temperature of hot rolling is adjusted to the temperature of 300° to 350° C., intermediate annealing can be omitted while keeping 45° earing ratio in the required range.

However, intermediate annealing serves effectively to complete the recrystallization of the material and to promote the precipitation of Mg, so that the qualities of the resulting hard tempered alloy sheet are stabilized and workability is highly improved. Thus, if necessary, the process annealing is performed.

Further, sheet $A_2$ showed the same result as sheet A shown in the drawing in measurement of the 45° earing ratios against various rolling reductions.

Referring the earing ratio measurement, deeply drawn cups were prepared for this measurement. The cups were obtained by deep drawing with a punch having flat base of diameter of 33 mm (R of the tip=2 mm) the test specimens of diameter of 55 mm in the form of round plate which were removed from the respective alloy sheets. The earing ratio is determined by measuring the mean height of ears and the mean height of saddle points in the angle of 45° or 90° and 0° to the rolling direction and by entering the measured values in the following equation.

$$\text{Earing Ratio (\%)} = \frac{\text{Mean height of ears}}{\text{Mean height of saddle points}} \times 100$$

TABLE 2

| | Sheets of the present invention | | Comparative sheets | |
|---|---|---|---|---|
| | $A_1$ | $A_2$ | $B_1$ | $C_1$ |
| Proof Stress (Kg/mm$^2$) | 31.8 | 32.3 | 32.0 | 32.2 |
| Tensile Strength Kg/mm$^2$) | 38.4 | 39.0 | 38.7 | 39.1 |
| Elongation (%) | 10 | 10 | 10 | 9 |
| 45° Earing Ratio (%) | 3.0 | 3.2 | 5.4 | 6.0 |
| Erichsen Value (mm) | 4.7 | 4.5 | 4.7 | 4.7 |
| Limiting of Drawing Ratio | 2.06 | 2.04 | 2.06 | 2.05 |

EXAMPLE 2

TABLE 3

| Component | Si | Fe | Cu | Mn | Mg | Cr | Zn | Ti | V | Al |
|---|---|---|---|---|---|---|---|---|---|---|
| Content (wt. %) | 0.08 | 0.16 | 0.04 | 0.08 | 5.2 | 0.06 | 0.01 | 0.03 | 0.01 | Balance |

Cast Ingot of the alloy composition shown in the above Table 3 was homogenized by heating for 10 hours at 525° C. and then hot rolled to provide a sheet of 2.5 mm in thickness at from the starting temperature of 500° C. to the finishing temperature of 326° C. The hot-rolled sheet was subjected to an intermediate annealing by heating for 1 hour at 350° C., thereafter to final cold rolling to the sheet thickness of 0.4 mm (rolling reduction of 84%) and further to stabilizing by heating for 30 minutes at 180° C. The properties of the resulting sheet $D_1$ are shown in the following Table 4.

Also, the same procedure as described above was carried out except for omitting the process annealing to provide a non-annealed sheet $D_2$ 0.4 mm thick and the properties of the resulting sheet $D_2$ are given by Table 4.

For comparison, the same ingot as the above was hot rolled to the sheet of 4 mm in thickness, and cold rolled to provide a sheet of 2.5 mm. The finishing temperature of the sheet at the final stage of hot rolling was 340° C. After cold rolling, the same intermediate annealing, finish cold rolling and stabilizing treatment as described above were conducted, thus providing comparative sheet $E_1$ 0.4 mm thick. The properties of the comparative sheet $E_1$ are indicated in Table 4.

TABLE 4

| | Sheets of the present invention | | Comparative sheet |
|---|---|---|---|
| | $D_1$ | $D_2$ | $E_1$ |
| Proof Stress (Kg/mm$^2$) | 33.5 | 33.9 | 33.4 |
| Tensile Strength (Kg/mm$^2$) | 41.1 | 41.2 | 40.6 |
| Elongation (%) | 8 | 8 | 9 |
| 45° Earing Ratio (%) | 3.4 | 3.3 | 6.9 |
| Erichsen Value (mm) | 4.0 | 4.0 | 4.1 |
| Limiting of Drawing Ratio | 2.02 | 2.01 | 2.02 |

As can be seen from Table 4, sheets $D_1$ and $D_2$ according to the present invention exhibited approximately 3.5% lower earing ratio level than comparative sheet $E_1$. This significant improvement demonstrates that the sheets according to the present invention are sufficient and useful material for deep drawing.

EXAMPLE 3

TABLE 5

| Component | Si | Fe | Cu | Mn | Mg | Cr | Zn | Ti | Al |
|---|---|---|---|---|---|---|---|---|---|
| Content | | | | | | | | | |

TABLE 5-continued

| Component | Si | Fe | Cu | Mn | Mg | Cr | Zn | Ti | Al |
|---|---|---|---|---|---|---|---|---|---|
| (wt. %) | 0.09 | 0.15 | 0.02 | 0.10 | 4.5 | 0.07 | <0.01 | 0.03 | Balance |

Two ingots of alloys of the composition shown in the above Table 5 were homogenized by heating for 10 hours at 525° C. and hot rolled to form a sheet 2.5 mm thick at the respective temperatures of (1) from a starting temperature of 500° C. to a finishing temperature of 322° C. and (2) from a starting temperature of 500° C. to the finishing temperature 285° C. The thus treated sheets were subjected to intermediate annealing by heating for 1 hour at 350° C., then to final cold rolling to provide the sheets of 0.4 mm in thickness (rolling reduction 84%) and finally to stabilizing treatment by heating for 30 minutes at 180° C., thereby preparing sheets $F_1$ and $G_1$, respectively, for the above finishing temperature of 322° C. and 285° C.

Further, the same procedure was carried out except for omitting the above intermediate annealing, obtaining sheets $F_2$ and $G_2$, corresponding to the sheets $F_1$ and $G_1$, respectively.

The properties of the above sheets $F_1$, $F_2$, $G_1$ and $G_2$ are summarized in Table 6. As is apparent from the results indicated in Table 6, when the finishing temperature of hot rolling was adjusted to the temperature of 322° C., the recrystallization proceeded sufficiently and therefore hardly any difference was noted between the properties of the annealed sheet $F_1$ and non-annealed sheet $F_2$.

However, when the above finishing temperature was 285° C., the intermediate annealing produced a preferable effect on a 45° earing ratio (sheet $G_1$). In this case, if the intermediate annealing is not conducted, (sheet $G_2$) recrystallization is not sufficiently proceeded. Thus, the 45° earing ratio becomes more than the intended value and workability does not fall short of the required level.

TABLE 6

| | Sheets of the present invention | | | Comparative sheet |
|---|---|---|---|---|
| | $F_1$ | $F_2$ | $G_1$ | $G_2$ |
| Proof Stress (Kg/mm$^2$) | 30.6 | 30.8 | 30.6 | 31.5 |
| Tensile Strength (Kg/mm$^2$) | 38.0 | 38.3 | 38.2 | 39.1 |
| Elongation (%) | 10 | 10 | 10 | 7 |
| 45° Earing Ratio (%) | 2.9 | 3.0 | 3.3 | 8.4 |
| Erichsen Value (mm) | 4.8 | 4.7 | 4.8 | 4.0 |
| Limiting of Drawing Ratio | 2.07 | 2.06 | 2.07 | 2.02 |

What is claimed is:

1. A process for preparing a hard tempered aluminum alloy sheet from an aluminum base alloy consisting essentially of from about 4 to about 6 wt. % magnesium, at least one component selected from the group consisting of from about 0.1 to about 0.7 wt. % of manganese, from about 0.01 to about 0.05 wt. % of zirconium, from about 0.005 to 0.12 wt. % of vanadium and up to about 0.05 wt. % of titanium, and the balance aluminum, comprising the steps of:

hot rolling an ingot of said aluminum base alloy to produce a sheet having a thickness of not more than 2.5 mm; then, without subjecting said sheet to a cold rolling step, effecting intermediate annealing of said sheet to recrystallize said alloy; and then effecting final cold rolling of said sheet at a rolling reduction of less than 85% to obtain a hard tempered aluminum alloy sheet having a 90% earing ratio of more than 2% and a 45° earing ratio of not more than 3.5% when the sheet is deep drawn.

2. A process according to claim 1, wherein said rolling reduction is 40 to less than 85%.

3. A process according to claim 13, wherein said rolling reduction is 70 to less than 85%.

4. A process according to claim 1 including further the step of heating said ingot at from about 480° to about 540° C. to homogenize said ingot before the hot rolling step.

5. A process according to claim 1 including further the step of stabilizing the cold rolled alloy after final cold rolling.

6. A process according to claim 4 including further the step of heating said sheet to a temperature of not more than 250° C. to stabilize said sheet after the final cold rolling step.

7. A process for preparing a hard tempered aluminum alloy sheet from an aluminum base alloy consisting essentially of from about 4 to about 6 wt. % magnesium, at least one component selected from the group consisting of from about 0.1 to about 0.7 wt. % of manganese, from about 0.01 to about 0.05 wt. % of zirconium, from about 0.005 to 0.12 wt. % of vanadium and up to about 0.05 wt. % of titanium, and the balance aluminum, comprising the steps of:

hot rolling an ingot of said aluminum base alloy to produce a sheet having a thickness of not more than 2.5 mm, said hot rolling step being performed so that the finishing temperature is from about 300 to about 350° effective to recrystallize said alloy; and then effecting final cold rolling of said sheet at a rolling reduction of less than 85% to obtain a hard tempered aluminum alloy sheet having a 90° earing ratio of more than 2% and a 45° earing ratio of not more than 3.5% when the sheet is deep drawn.

8. A process according to claim 7, wherein said rolling reduction is 40 to less than 85%.

9. A process according to claim 7, wherein said rolling reduction is 70 to less than 85%.

10. A process according to claim 7 including further the step of heating said ingot at from about 480° to about 540° C. to homogenize said ingot before the hot rolling step.

11. A process according to claim 7 including further the step of stabilizing the cold rolled alloy after final cold rolling.

12. A process according to claim 10 including further the step of heating said sheet to a temperature of not more than 250° to stabilize said sheet after the final cold rolling step.

13. A process for preparing a hard tempered aluminum alloy sheet from an aluminum base alloy consisting essentially of from about 4 to about 6 wt. % magnesium, at least one component selected from the group consisting of from about 0.1 to about 0.7 wt. % of manganese, from about 0.01 to about 0.05 wt. % of zirconium, from about 0.005 to 0.12 wt. % of vanadium and up to about 0.05 wt. % of titanium, and the balance aluminum, consisting essentially of the steps of:

heating a homogenized ingot of said aluminum base alloy to a temperature of from about 460° to about 540° C. and then hot rolling said heated ingot to produce a sheet having a thickness of not more than 2.5 mm; then, without subjecting said sheet to a cold rolling step, heating said sheet at from about 300° to about 350° C. for about 1 hour to recrystallize said alloy; then effecting final cold rolling of said sheet at a rolling reduction of less than 85% and then heating said sheet at a temperature of not more than 250° C. to stabilize the sheet and thereby obtaining a hard tempered aluminum alloy sheet having a thickness of less than about 0.4 mm, a 90° earing ratio of from 5 to 6% and a 45° earing ratio of not more than 3.5% when the sheet is deep drawn.

14. A process for preparing a hard tempered aluminum alloy sheet from an aluminum base alloy consisting essentially of from about 4 to about 6 wt. % magnesium, at least one component selected from the group consisting of from about 0.1 to about 0.7 wt. % of manganese, from about 0.01 to about 0.05 wt. % of zirconium, from about 0.005 to 0.12 wt. % of vanadium and up to about 0.05 wt. % of titanium, and the balance aluminum, consisting essentially of the steps of:

hot rolling a homogenized ingot of said aluminum base alloy to produce a sheet having a thickness of not more than 2.5 mm, said hot rolling step being performed at a starting temperature of from about 460° to about 540° C. and a finishing temperature of from about 300° to about 350° C. during a time period of from 5 to 10 minutes so that said alloy is recrystallized;

then effecting final cold rolling of said sheet at a rolling reduction of less than 85% and then heating said sheet at a temperature of not more than 250° C. to stabilize the sheet and thereby obtain a hard tempered aluminum alloy sheet having a thickness of less than about 0.4 mm, a 90° earing ratio of from 5 to 6% and a 45° earing ratio of not more than 3.5% when the sheet is deep drawn.

* * * * *

UNITED STATES PATENT AND TRADEMARK OFFICE

CERTIFICATE OF CORRECTION

PATENT NO. : 4 284 437

DATED : August 18, 1981

INVENTOR(S) : Yoshio Baba, Shin Tsuchida and Masaaki Tobinaga

It is certified that error appears in the above—identified patent and that said Letters Patent is hereby corrected as shown below:

Col. 8, line 7; change "90%" to ---90°---.

Col. 8, line 12; change "claim 13" to ---claim 1---.

Signed and Sealed this

*Fifteenth* Day of *December 1981*

[SEAL]

*Attest:*

GERALD J. MOSSINGHOFF

*Attesting Officer*

*Commissioner of Patents and Trademarks*